United States Patent [19]

Jinkins

[11] 4,281,964

[45] Aug. 4, 1981

[54] TURBINE HOUSING AND METHOD FOR MAKING THE SAME

[75] Inventor: Danny R. Jinkins, Bel Air, Md.

[73] Assignee: Black & Decker Inc., Newark, Del.

[21] Appl. No.: 113,801

[22] Filed: Jan. 21, 1980

[51] Int. Cl.[3] ..... F01D 25/24

[52] U.S. Cl. ..... 415/203; 415/219 C; 415/DIG. 5; 138/37

[58] Field of Search ..... 138/37, 39, 44, 155; 415/203, 206, 207, 219 A, 219 C, DIG. 5

[56] References Cited

U.S. PATENT DOCUMENTS

| | | | |
|---|---|---|---|
| 31,810 | 3/1861 | Locke | 415/219 C |
| 373,077 | 11/1887 | Larrabee | 138/37 X |
| 704,038 | 7/1902 | Hope | 415/219 C |
| 2,206,286 | 7/1940 | Karmazin | 138/155 X |
| 3,165,123 | 1/1965 | Hawkins | 138/37 |

FOREIGN PATENT DOCUMENTS

| | | | |
|---|---|---|---|
| 614865 | 2/1961 | Canada | 415/219 C |
| 340379 | 1/1931 | United Kingdom | 138/39 |

*Primary Examiner*—Leonard E. Smith
*Attorney, Agent, or Firm*—Harold Weinstein; Leonard Bloom; Edward D. Murphy

[57] ABSTRACT

A turbine housing is formed which comprises a plurality of housing members. The distance between mating portions of opposite side walls of one housing member is a first distance and the distance between mating portions of opposite side walls at one end of an adjacent member in the direction of fluid flow in the turbine is greater than or equal to the first distance. The distance between the mating portions of opposite side walls at the other end of the adjacent member is less than or equal to the first distance. Further, the distance from the axis of the housing to the mating portion of the circumferential wall which connects opposite side walls of the one housing member is less than or equal to the radial distance to the circumferential wall at the one end of the adjacent member and the distance to the circumferential wall at the other end of the adjacent member is less than or equal to the distance from the axis of the circumferential wall of the one housing member.

15 Claims, 12 Drawing Figures

FIG. 1A
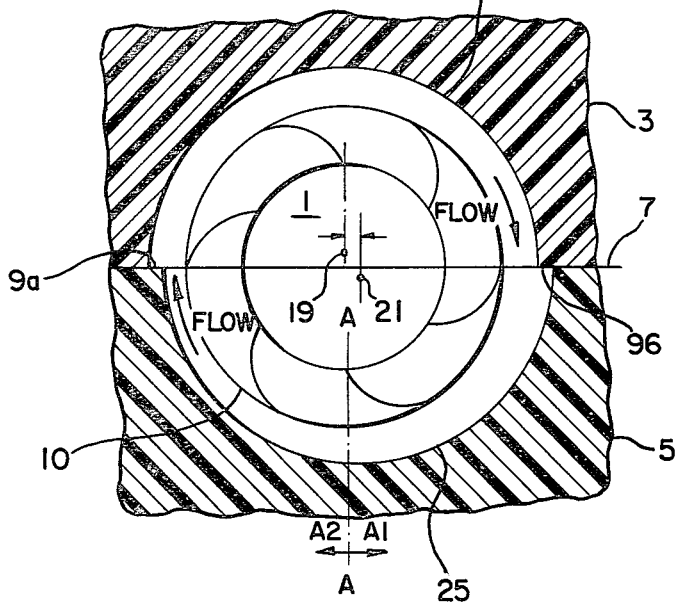
FIG. 1B
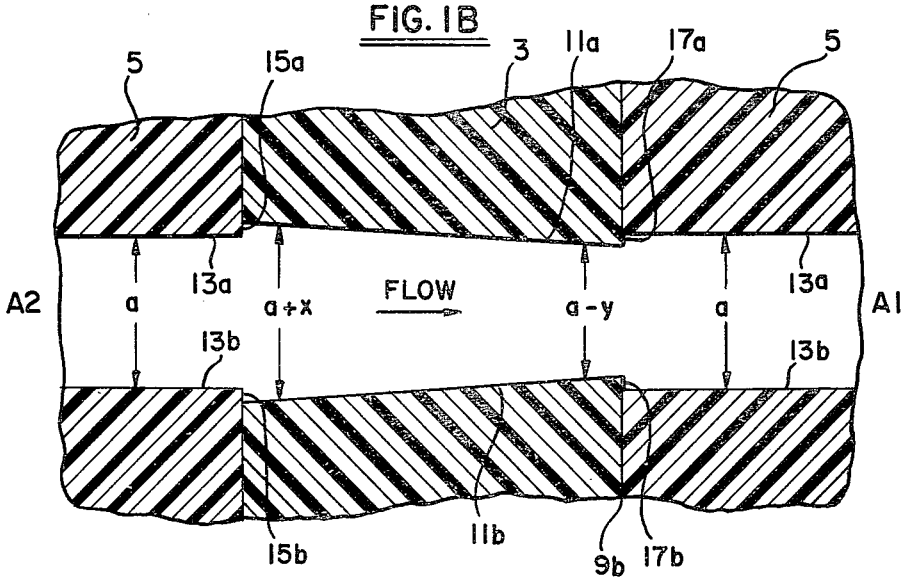
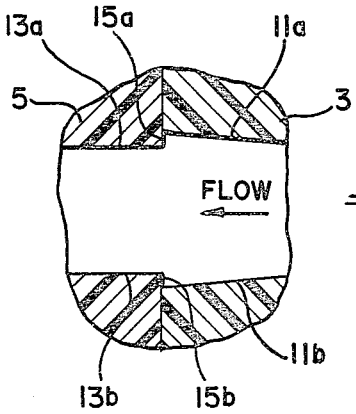
FIG. 1C

TURBINE HOUSING AND METHOD FOR MAKING THE SAME

BACKGROUND OF THE INVENTION

1. Field of the Invention

The present invention is directed to turbine housings and a method of forming a turbine housing and, in particular, to a turbine housing and a method for forming the turbine housing in which the housing is formed from a plurality of members and the air turbulence at the mating portions of the members is reduced by offsetting the mating wall portions of one of the members with respect to those of the other member. The mating portions are offset with respect to one another such that air flowing in the turbine housing formed by the wall members does not see the edge of the mating wall portions of the second member in the direction of flow.

The term "flow" as used herein is used to describe the path and movement of the working fluid from the turbine inlet to the turbine housing exit. Obstructions to flow are of particular importance due to the frictional resistance put on the turbine rotor when this field of rotating fluid is impeded. The fluid can be thought of as rotating with the turbine rotor in planes of equal thickness, the planes closer to the turbine rotor having more frictional bond to the turbine rotor than the planes further from the turbine rotor. Because of friction between the planes and with the turbine rotor, obstruction to the movement of a plane close to the turbine rotor is particularly detrimental. Hence, the problem of obstructions in the path of the fluid flow is most critical when the turbine housing is designed to be minimized because obstructions in the housing walls are close to the turbine rotor.

2. Description of the Prior Art

In prior art turbine housings, the housings are formed by placing together a plurality of housing sections or mating members. These housing sections or mating members are joined together at mating wall portions. A single unitary housing is not formed because of the difficulty in manufacturing. For example, in small air turbines which are made of molded plastic, it would be extremely difficult to form a mold which could produce a unitary housing. Thus, in a commercial environment, it has become necessary to form a plurality of sections and then fasten or fix these sections together.

In the manufacture of housing sections, it is standard practice to design the distance between opposite walls of each of the housing sections to be equal. Further, in the peripheral wall of the housing, which is usually circular, the same radius is used for each of the housing sections.

As a practical matter, the distance between opposite walls and the radius have a certain tolerance and, in some situations, the distance between opposite walls is less than the designed distance and, in some cases, it is greater than the designed distance. Because of this variation in distance, when two adjacent housing sections are placed together, if the distance between opposite walls at the mating portions of a succeeding section in the direction of flow is less than the distance between opposite walls at the mating portions of the preceding section, then air flowing in the turbine will see the edges of the mating surface of the succeeding housing section which project into the housing which forms the turbine chamber. These projections will create air turbulence. Furthermore, the air turbulence created by the projections will itself create additional air turbulence which will extend further into the housing. This air turbulence reduces the efficiency of the turbine.

SUMMARY OF THE INVENTION

It is the primary object of the present invention to provide an air turbine housing formed from a plurality of housing sections in which the edges of a succeeding section in the direction of flow do not have steps which project beyond the edges of a preceding section in the direction of flow, thereby reducing air turbulence at the mating portions of adjacent housing sections.

It is another object of the present invention to provide a method for forming a turbine housing from a plurality of mating members or wall sections wherein a succeeding wall section in the direction of flow is positioned with respect to a preceding wall section such that they are offset with respect to one another and such that there are no projections or steps at the mating sections which project into the turbine chamber to interfere with the flow and thereby create air turbulence.

It is another object of the present invention to form housing sections or mating members for a turbine housing wherein the distance between opposite walls is made less than a predetermined distance, and then one end is beveled so that the distance between opposite walls at that end is greater than a predetermined distance.

The present invention is directed to a turbine housing which comprises a plurality of housing members. The distance between mating portions of opposite side walls of one housing member is a first distance and the distance between mating portions of opposite side walls at one end of an adjacent member in the direction of fluid flow in the turbine is greater than, or equal to, the first distance. The distance between the mating portions of opposite side walls at the other end of the adjacent member is less than, or equal to, the first distance. Further, the distance from the axis of the housing to the mating portion of the circumferential wall which connects opposite side walls of the one housing member is less than, or equal to, the radial distance to the circumferential wall at the one end of the adjacent member and the distance to the circumferential wall at the other end of the adjacent member is less than, or equal to, the distance from the axis to the circumferential wall of the one housing member.

The present invention is also directed to a method of forming a turbine housing to reduce the turbulence therein. The method comprises forming a first housing member with a predetermined distance between opposite walls thereof and forming a second housing member wherein the distance between opposite walls at one end thereof is greater than the predetermined distance and the distance between opposite walls at the other end thereof is less than the predetermined distance. The first and second members are fitted together with the first end of the second member being adjacent to the first member, and the flow path through the housing is in a direction from the first member into the second member through the first end thereof.

BRIEF DESCRIPTION OF THE DRAWINGS

FIGS. 1A, 1B and 1C are diagrams illustrating the principle of the present invention.

DETAILED DESCRIPTION OF THE PREFERRED EMBODIMENT

Figure 2A:
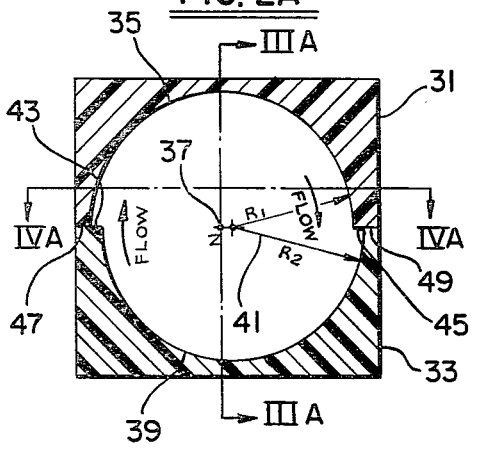
FIGS. 2A and 2B are sectional views of a turbine of the present invention.

FIGS. 1A and 1B illustrate the principle of the present invention. A turbine chamber 1 is formed by upper and lower sections 3 and 5 which are mated along plane 7. The upper and lower portions 3 and 5 are offset with respect to one another at 9*a* and 9*b*. Turbine rotor 10 is rotatably mounted within turbine chamber 1.

FIG. 1B shows FIG. 1A cut along line A—A and folded in the directions illustrated by the arrows and then viewed from the bottom looking up. The distance between the side walls 11*a* and 11*b* of the upper section 3 varies in the direction of flow. At the left hand side, which is the upstream side, the distance is a first distance "a" plus an additional increment "x", i.e., (a+x), and at the right hand side, which is the downstream side, the distance between walls 11*a* and 11*b* is a distance "a"less an increment "y", i.e. (a−y). The distance between side walls 13*a* and 13*b* of lower section 5 is constant throughout the length of the chamber, and is equal to the distance "a". As flow enters the upper section 3 from the upstream side, it does not see the step 15*a* and 15*b* which are formed as a result of the different distances between the side walls of upper section 3 and lower section 5. Further, as flow exits from the downstream end of section 3 and enters section 5, it does not see the steps 17*a* or 17*b*. Since the flow through the turbine does not encounter any steps, turbulence in the flow is substantially reduced.

FIG. 1C shows a portion of FIG. 1B with the flow reversed. If the flow is reversed then, as the fluid in the turbine strikes the steps 15*a* and 15*b*, turbulence is created. This turbulence will extend into the chamber itself and will create additional turbulence. As can be seen, the area of flow through the turbine is thus substantially reduced. Thus, it is essential in the present invention that direction of flow be such that fluid flowing in the turbine chamber does not see the steps between adjacent sections in the turbine housing.

In manufacturing sections for a turbine housing which incorporates the present invention, section 3 is manufactured with the distances between the side walls as shown with tolernaces of $\pm\frac{1}{2}x$, where y=x. Thus, when viewing the upstream end, for example, if the distances between side walls 11*a* and 11*b* was "a+x" with a maximum deviation of $-\frac{1}{2}x$, then the actual distance between side walls 11*a* and 11*b* would be "$a+x-\frac{1}{2}x$". The distance between side walls 13*a* and 13*b* is "a" with a deviation of $\pm\frac{1}{2}x$ and, therefore, in the situation of maximum deviation of $\pm\frac{1}{2}x$, the air flowing from lower section 5 to upper section 3 would not see a step at the mating portions of these two sections because, in fact, the distances between side walls would be the same.

Referring again to FIG. 1A, the center 19 of upper section 3 is offset by a distance "z" from the center 21 of lower section 5. Steps 9*a* and 9*b* are thus equal to the distance "z" and, as can be seen, the flow does not see the steps 9*a* and 9*b*.

In manufacturing, the offset of the center of the upper and lower sections 3 and 5 is "z" with a maximum tolerance of ±z. Thus, in the worst case, offset would be zero and the circumferential walls 23 and 25 would be aligned. Therefore, the flow would not encounter any steps.

Figure 2B:
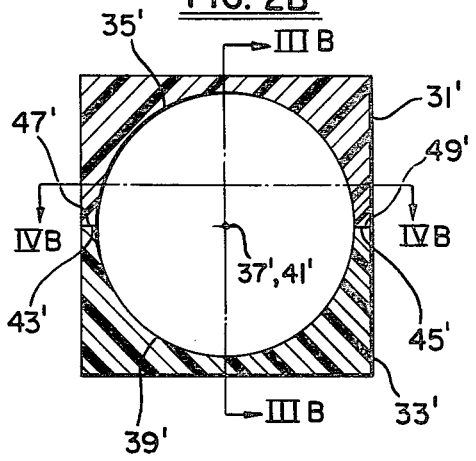
Figure 3A:
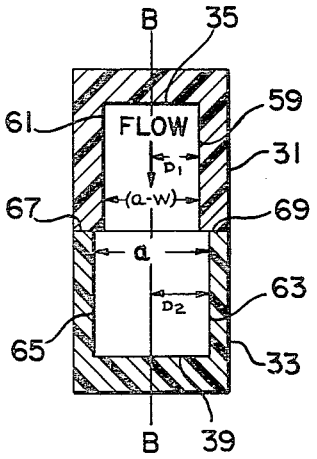
FIGS. 3A and 3B are sections through section IIIA—IIIA and IIIB—IIIB, respectively.
Figure 3B:
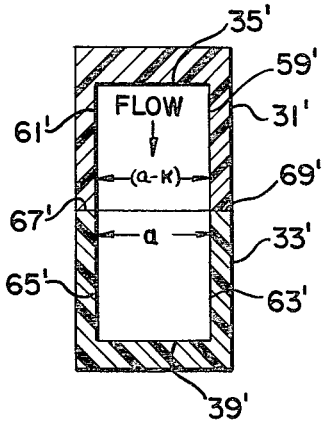
Figure 4A:
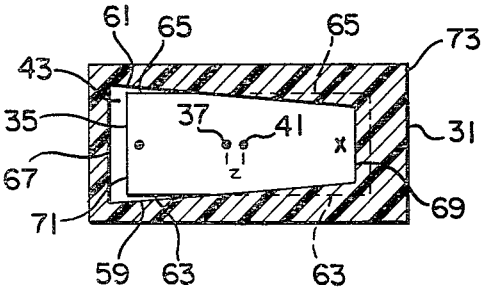
FIGS. 4A and 4B are sectional views through section IVA—IVA and IVB—IVB, respectively.
Figure 4B:
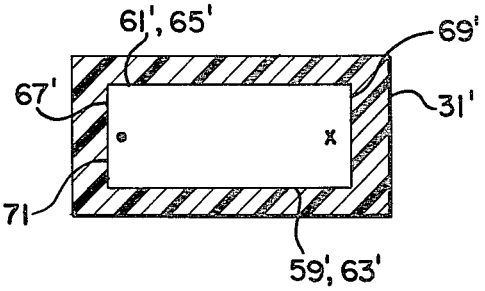

FIGS. 2A, 3A and 4A illustrate one embodiment of the present invention. The upper and lower members are formed at the design dimensions within the tolerance limits. FIGS. 2B, 3B and 4B illustrate a corresponding embodiment in which the upper and lower members are formed at maximum tolerance deviation. For simplification in explanation, the elements in FIGS. 2B, 3B and 4B will be given the same numbers as the corresponding elements in FIGS. 2A, 3A and 4A, except that they will be designated with a ′ (prime).

Referring to these Figures, a turbine chamber or housing is formed from upper member or section 31 and lower member or section 33. The radial center of inner peripheral surface 35 of upper section 31 is located at 37, and the radial center of the inner peripheral surface 39 of the lower section 33 is located at 41. It can be seen in FIG. 2B that 37′ and 41′ coincide. The distance "z" between centers 37 and 41 corresponds to the width of the steps 43 and 45, which are formed at the mating surfaces 47 and 49 of the upper and lower sections 31 and 33. It can be seen in FIG. 2B that the width of the steps 43′ and 45′ is zero.

Referring to FIGS. 3A and 3B, the distance between opposite inner peripheral walls 59 and 61 of upper section 31 is "a−x". The distance between inner peripheral walls 63 and 65 of lower section 33 is "a", and thus results in the formation of steps 67 and 69. The flow, which is in the downward direction, does not see these steps. Referring to FIG. 3B, the increment x=O.

If Section IIIA in FIG. 2A were taken looking in the other direction, then the distance between opposite peripheral walls 59 and 61 would be "a+x". The length of edge 67 is "a+X, the length of edge 69 is "a−x" and the length of edges 71 and 73 is "a". The length of edge 67′ is "a+x" where "x" is zero and the length of edge 69 is "a−x" where "x" is zero.

In the embodiment of FIGS. 2A, 3A and 4A and FIGS. 2B, 3B and 4B, it can be seen that the flow of fluid in the turbine chamber or housing does not see any steps at the mating surfaces of the sections of the turbine chamber and thus turbulence caused by steps found in prior art devices is eliminated.

Referring to FIG. 2A, if the axis of the turbine passes through center 41 of lower section 33, then the radial distance R1 to the circumferential peripheral surface 35 of the upper section 31 is less than the radial distance R2 to the circumferential surface 39 of lower section 33, which is the second section in the direction of flow.

Referring to FIG. 3A, if a plane B—B passes through the center of the housing and is perpendicular thereto as illustrated, then the distance D1 from the plane to the side wall 59 of the upper section 31 is less than the distance D2 from the plane to the side wall 63 of lower section 33 with lower section 33 being the second section in the direction of flow, and upper section 31 being the first section in the direction of flow.

In manufacturing a turbine housing of the present invention, the housing can be made from more than two sections. If this is done, then the mating portions between each of the adjacent sections are formed in the manner illustrated above in order to eliminate any steps in the direction of flow.

Figure 5:
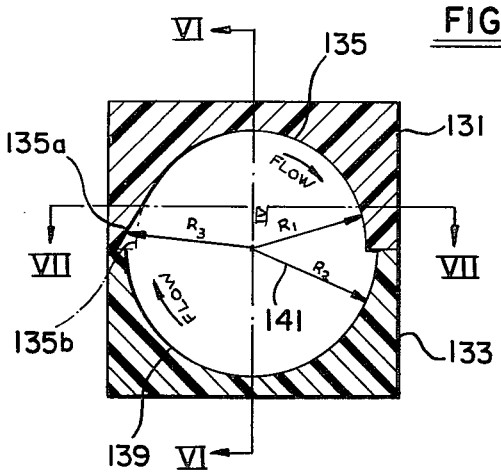
FIG. 5 is a sectional view of an alternate embodiment of the present invention.
Figure 6:
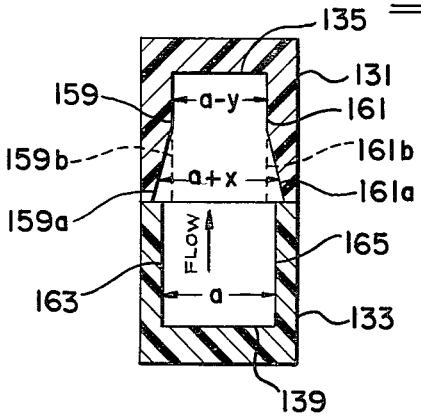
FIG. 6 is a sectional view through section VI—VI.
Figure 7:
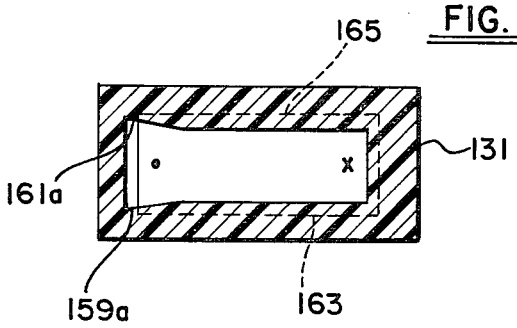
FIG. 7 is a sectional view through section VII—VII.

FIGS. 5, 6 and 7 illustrate another embodiment of the present invention in which elements corresponding to those in FIGS. 2A, 3A and 4A have been designated by the same element number in the 100 series.

Referring to FIGS. 5, 6 and 7, rather than forming the upper member 31 with varying dimensions from end to end as in the embodiment of FIGS. 2A, 3A and 4A, the upper member 131 is formed having an inner circumferential surface 135 with a radius R1 which is less than the radius of the inner circumferential wall of the lower member or section 133. After upper member 131 is formed, surface 135*a*, is formed by beveling portion 135*b* of peripheral surface 135.

In FIG. 6, upper section 131 is formed with the distance between the side walls 159 and 161 being made "a−y" and the distance between opposite side walls 163 and 165 of lower section 133 being "a". When upper section 131 is formed, then side wall sections 159*a* and 161*a* are formed by beveling portions 159*b* and 161*b* of side walls 159 and 161 so that the maximum distance is "a+x".

The resulting structure is similar to that shown in FIGS. 2A, 3A and 4A in that the flow does not encounter any steps which can cause turbulence.

The present invention may be embodied in other specific forms without departing from the spirit or essential characteristics thereof. The presently disclosed embodiments are, therefore, to be considered in all respects as illustrative and not restrictive, the scope of the invention being indicated by the appended claims rather than the foregoing description, and all changes which come within the meaning and range of equivalency of the claims are, therefore, to be embraced therein.

What is claimed is:

1. A turbine housing formed from at least two mating members, said at least two mating members having mating wall portions which are positioned adjacent to each other to form the peripheral walls of said housing, wherein said mating wall portions are offset from one another such that the distance from the plane through the center of the housing and parallel to the walls of the mating members, to the first mating wall portions, in the direction of fluid flow in the turbine, is less than or equal to the distance from said plane to the second mating wall portions, in the direction of flow.

2. A turbine housing as set forth in claim 1 wherein the distance from the axis of the turbine housing to the first mating wall portions, in the direction of flow, is less than or equal to the distance from said axis to the second mating wall portions, in the direction of flow.

3. A turbine housing formed from at least two housing sections, said at least two housing sections having mating wall portions which are positioned adjacent to each other to form the peripheral walls of said housing, wherein said mating wall portions are offset from one another such that the distance from the axis of the turbine housing to the first mating wall portions, in the direction of fluid flow in the turbine, is less than or equal to the distance from said axis to the second mating wall portions in the direction of flow.

4. A turbine housing as set forth in any of claims 1–3 wherein the second mating wall portions are beveled with respect to the peripheral walls of the second mating member.

5. An air turbine housing comprising a plurality of housing members wherein the distance between mating portions of opposite side walls of one housing member is a first distance and the distance between the mating portions of opposite side walls at one end of an adjacent member, in the direction of fluid flow in the turbine, is greater than or equal to said first distance and the distance between the mating portions of opposite side walls at the other end of said adjacent member is less than or equal to said first distance.

6. An air turbine housing as set forth in claim 5 wherein the distance between opposite walls of said adjacent member is less than or equal to said first distance and wherein the walls are tapered outward at the one end thereof to a distance greater than or equal to said first distance.

7. A housing for use with a turbine comprising at least two adjacent wall members forming the turbine chamber, the wall members having a U shaped cross-section, wherein the interior surfaces of said adjacent wall members are offset with respect to one another such that the cross-sectional area of the chamber formed by the mating portion of a first of said adjacent wall members is less than or equal to the cross-sectional area of the chamber formed by the mating portion of a second of said adjacent wall members, in the direction of fluid flow in said chamber.

8. A turbine housing formed from at least two adjacent sections, said adjacent sections being mated to each other at mating portions thereof, a first of said adjacent section having oppossed side walls wherein the distance between said oppossed side walls is a first distance and wherein the opposed side walls at the mating portion of said first section at one end thereof is beveled such that the distance between the oppossed side walls at the beveled portion thereof is a second distance, the second distance being greater than the first distance, and wherein the distance between oppossed side walls of the other of said adjacent sections is a third distance which is greater than said first distance and less than said second distance.

9. A turbine housing as set forth in claim 8 wherein said adjacent sections have curved walls formed between said opposed walls and wherein the radius of the curved wall of the first section is a first radius and the curved wall at the mating portion at one end of said first section is beveled such that the radius is a second radius which is greater than the first radius, and wherein the radius of the curved wall of the other of said adjacent sections is a third radius which is greater than said first radius and less than said second radius.

10. A turbine housing formed from at least two adjacent sections, said adjacent sections being mated to each other at mating portions thereof, a first of said adjacent sections having oppossed side walls and a first curved wall therebetween and a second of said adjacent sections having oppossed side walls and a second curved wall therebetween, wherein the radius of the first curved wall is a first radius and the radius of the second curved wall is a second radius wherein the second radius is greater than the first radius, and wherein the first curved wall is tapered outward at one mating portion thereof such that the radius at said mating portion is a third radius, said third radius being greater than said second radius.

11. A method of forming a turbine housing to reduce turbulence therein comprising forming a first housing member having a predetermined distance between opposite walls thereof; forming a second housing member wherein the distance between opposite walls at one end thereof is greater than the predetermined distance and the distance between opposite walls at the other end thereof is less than the predetermined distance; fixing said first and second members together with the first end of said second member being adjacent to the first member wherein the flow path through said housing is in a direction from said first member into the second member through the first end thereof.

12. A method as set forth in claim 11 including forming a curved wall between said opposite walls of said first and second members wherein the radius of the curved wall at the one end of said second member is greater than the radius of the curved wall of the first member.

13. The method of claim 12 wherein the radius of the curved wall at the other end of the second member is less than the radius of the curved wall of the first member.

14. The method of any of claims 11–13 including first forming said second member with the distance between opposite walls less than the predetermined distance and then beveling said opposite walls at the one end thereof.

15. A method as set forth in claim 14 including first forming said curved wall of said second member with a radius less than the radius of the curved wall of the first member and then beveling said curved wall at the one end thereof.

* * * * *